United States Patent [19]

Gassman

[11] Patent Number: 5,016,580

[45] Date of Patent: May 21, 1991

[54] CAM DRIVE DIESEL ENGINE UTILIZING DOUBLE ACTING PISTONS

[76] Inventor: Walter J. Gassman, P.O. Box 128, Hackensack, N.J. 07602

[21] Appl. No.: 427,772

[22] Filed: Oct. 27, 1989

[51] Int. Cl.[5] ..... F02B 75/26

[52] U.S. Cl. ..... 123/58 A; 123/276

[58] Field of Search ..... 123/58 R, 58 A, 58 AA, 123/61 R, 63, 269, 307, 261, 276

[56] References Cited

U.S. PATENT DOCUMENTS

| | | | |
|---|---|---|---|
| 1,352,985 | 9/1920 | Murphy | 123/58 AA |
| 2,431,875 | 12/1947 | Mackenzie | 123/276 |
| 4,779,587 | 10/1988 | Schweinzer et al. | 123/276 |

FOREIGN PATENT DOCUMENTS

| | | | |
|---|---|---|---|
| 453701 | 12/1927 | Fed. Rep. of Germany | 123/58 A |
| 3248038 | 6/1984 | Fed. Rep. of Germany | 123/269 |
| 3408447 | 9/1985 | Fed. Rep. of Germany | 123/58 A |
| 901982 | 7/1962 | United Kingdom | 123/261 |

*Primary Examiner*—Noah P. Kamen

*Attorney, Agent, or Firm*—Leon Gilden

[57] ABSTRACT

A diesel engine converts the reciprocating motion of its pistons to a rotating motion through the use of a cam assembly. The engine utilizes free floating pistons mounted in cylinders having combustion chambers at both ends. Each combustion chamber is uniquely designed to maximize precombustion air and fuel mixing. The pistons are provided with radially directed pins which act as followers and are positioned in the cam groove of a power cam wheel which operates to rotate the crankshaft.

2 Claims, 9 Drawing Sheets

CAM DRIVE DIESEL ENGINE UTILIZING DOUBLE ACTING PISTONS

BACKGROUND OF THE INVENTION

1. Field of the Invention

The present invention relates to improvements in free piston, internal combustion engines, and more particularly pertains to a new and improved free piston diesel engine having a novel combustion chamber design and cam drive arrangement.

2. Description of the Prior Art

The construction and use of free piston engines is well known in the prior art. The basic conceptual design of such engines is disclosed in many patent references, such as U.S. Pat. No. 4,480,599 which issued to E. Alllais on Nov. 6, 1984, U.S. Pat. No. 4,142,485 which issued to A. Morioux et al on Mar. 6, 1979, and U.S. Pat. No. 3,214,085 which issued to H. Boldt on Oct. 26, 1965. These three patent references are all illustrative of the free piston design concept but are not particularly specific as to the drive means for an associated power output shaft.

With respect to power output arrangements associated with such free piston engines, it appears that rack and pinion drives have long represented the preferred approach in the prior art. In this respect, reference is made to U.S. Pat. Nos. 3,610,214 and 3,853,100, both of which issued to A. Braun on Oct. 5, 1971 and Dec. 10, 1974, respectively. Both of these patents disclose double acting free piston engines which rely upon the aforementioned rack and pinion drives to obtain a power output.

Inasmuch as free piston engines apparently are not presently available in a commercial market, it appears that there exists a continuing need for improvements thereto which could make them more efficient,, inexpensive and thus commercially feasible. In this respect, the present invention substantially fulfills this need.

SUMMARY OF THE INVENTION

In view of the foregoing disadvantages inherent in the known types of free piston engines now present in the prior art, the present invention provides an improved free piston engine construction wherein the free pistons are provided with radially extending pins which act as followers in a groove associated with a cam wheel that operably drives an associated power output crankshaft. As such, the general purpose of the present invention, which will be described subsequently in greater detail, is to provide a new and improved free piston engine construction which has all the advantages of the prior art free piston engine constructions and none of the disadvantages.

To attain this, the present invention essentially consists of an engine designed in a manner which permits the converting of the reciprocating motion of its pistons to a rotating motion through the use of a drive pin arrangement associated with each piston. As mentioned, the drive pins extend radially outward from each piston and are utilized as followers in a cam groove of a power cam wheel operably attached to the engine crankshaft. Each piston is positioned in a cylinder having combustion chambers at both ends, and each combustion chamber of a particular piston fires once every one hundred eighty degrees of crankshaft rotation, so that each double acting piston experiences four combustion firings per crankshaft revolution. In a four cylinder engine comprising the preferred embodiment then, a total of sixteen combustion firings occurs per crankshaft revolution, and this provides for a more balanced operation at a much lower engine rpm. By the same token, the equivalent piston speed of a reciprocating engine is provided and accordingly, a greater horsepower and torque is realized.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved free piston engine which has all the advantages of the prior art free piston engines and none of the disadvantages.

It is another object of the present invention to provide a new and improved free piston engine which may be easily and efficiently manufactured and marketed.

It is a further object of the present invention to provide a new and improved free piston engine which is of a durable and reliable construction.

An even further object of the present invention is to provide a new and improved free piston engine which is susceptible of a low cost of manufacture with regard to both materials and labor, and which accordingly is then susceptible of low prices of sale to the consuming public, thereby making such free piston engines economically available to the buying public.

Still yet another object of the present invention is to provide a new and improved free piston engine which provides in the apparatuses and methods of the prior art some of the advantages thereof, while simultaneously overcoming some of the disadvantages normally associated therewith.

Still another object of the present invention is to provide a new and improved free piston engine which utilizes a superiorly designed combustion chamber arrangement.

Yet another object of the present invention is to provide a new and improved free piston engine which utilizes a cam drive to obtain power output.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

.

FIG. 5 is a basic cross-sectional view of the engine arrangement comprising the present invention.

FIG. 6 is a cross-sectional view of a typical free piston forming a part of the present invention.

FIG. 7 is an end view of the drive cam showing the free pistons operably associated therewith.

FIG. 12 is an end view of a valve drive wheel.

FIG. 13 shows the drive wheel engaging valve followers.

FIG. 14 shows followers connected to the inlet exhaust valves.

FIG. 15 is a cross-section of a combustion cylinder and piston.

DESCRIPTION OF THE PREFERRED EMBODIMENT

Figure 1:
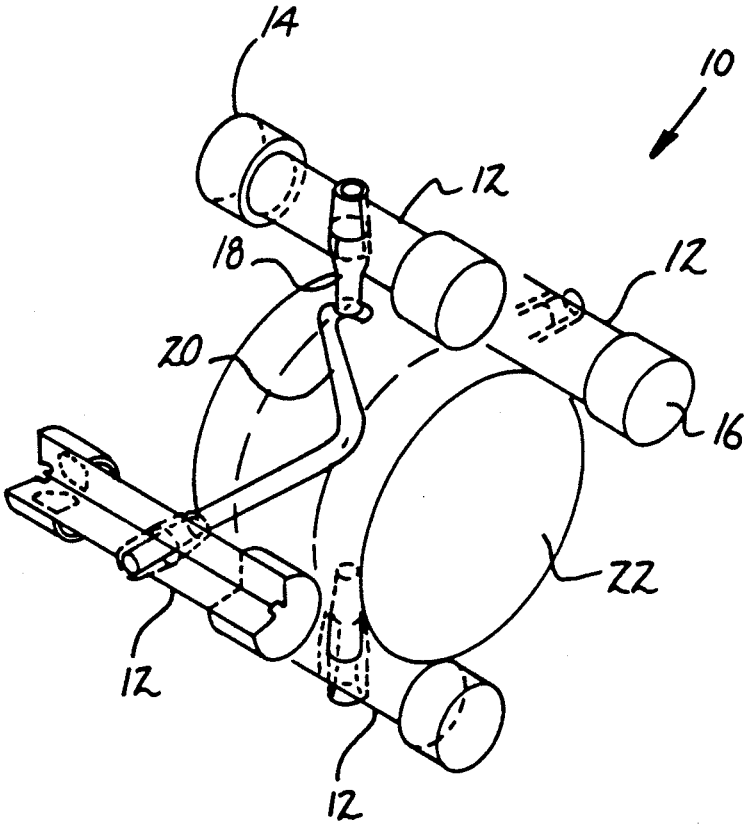
FIG. 1 is a perspective view of the drive cam and double acting piston arrangement forming the basic construction of the present invention.

With reference now to the drawings, and in particular to FIG. 1 thereof, a new and improved cam driven diesel engine utilizing double acting pistons embodying the principles and concepts of the present invention and generally designated by the reference numeral 10 will be described.

More specifically, the basic concept of the invention is illustrated in FIG. 1 wherein a preferred embodiment thereof shows four free pistons 12, each of which has opposed piston heads 14, 16 which are positionable in unillustrated opposed combustion chambers. Each piston 12 is provided with a centrally positioned, radially extending pin 18 which is orthogonally aligned with the axis of movement of the piston. The pins 18 act as followers and engage a cam groove 20 machined into the circumferential surface of a cylindrically-shaped power cam wheel 22.

The arrangement of FIG. 1 thus illustrates the basic concept of the present invention 10 wherein the free floating pistons 12 are reciprocated in their respective combustion chambers with the followers 18 then effecting a rotation of the power cam wheel 22. This rotation of the power cam wheel 22 results in a delivered power takeoff to conventional accessories in a manner which will be subsequently described.

Figure 2:
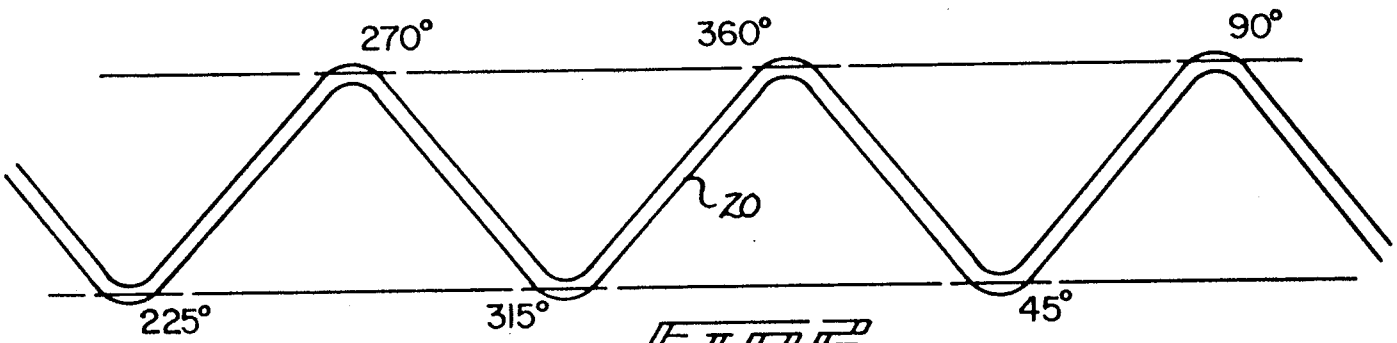
FIG. 2 is a flat pattern representation of the cam groove forming a part of the drive cam.
Figure 3:
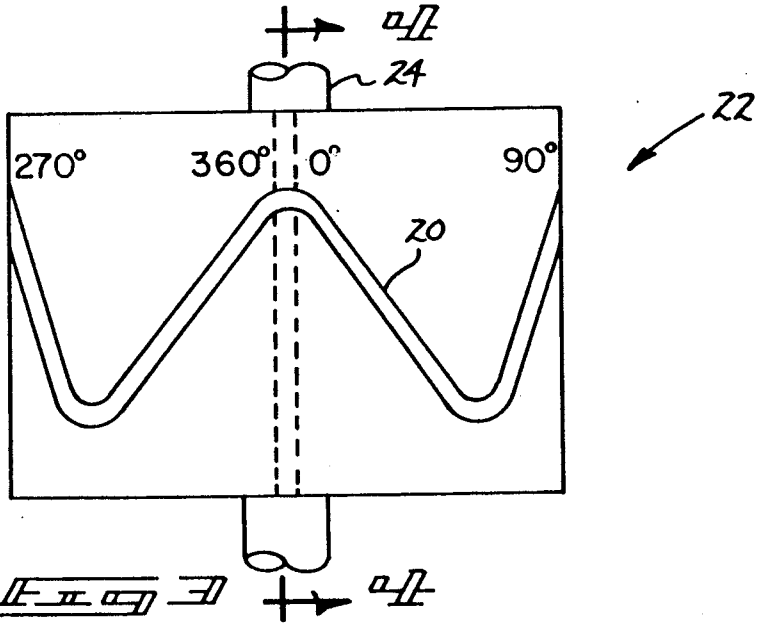
FIG. 3 is a side elevation view of the drive cam.
Figure 4:
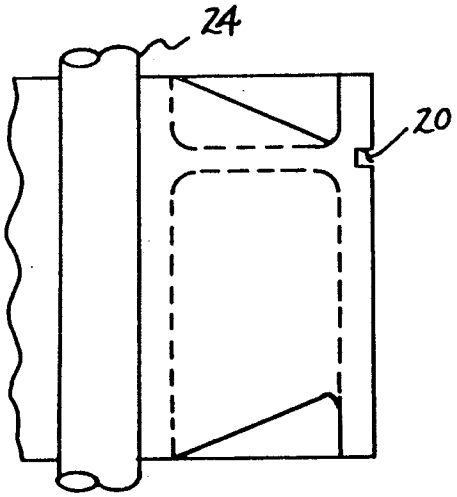
FIG. 4 is a partial cross-sectional view of the drive cam as viewed along the line 4—4 shown in FIG. 3.
Figure 3:
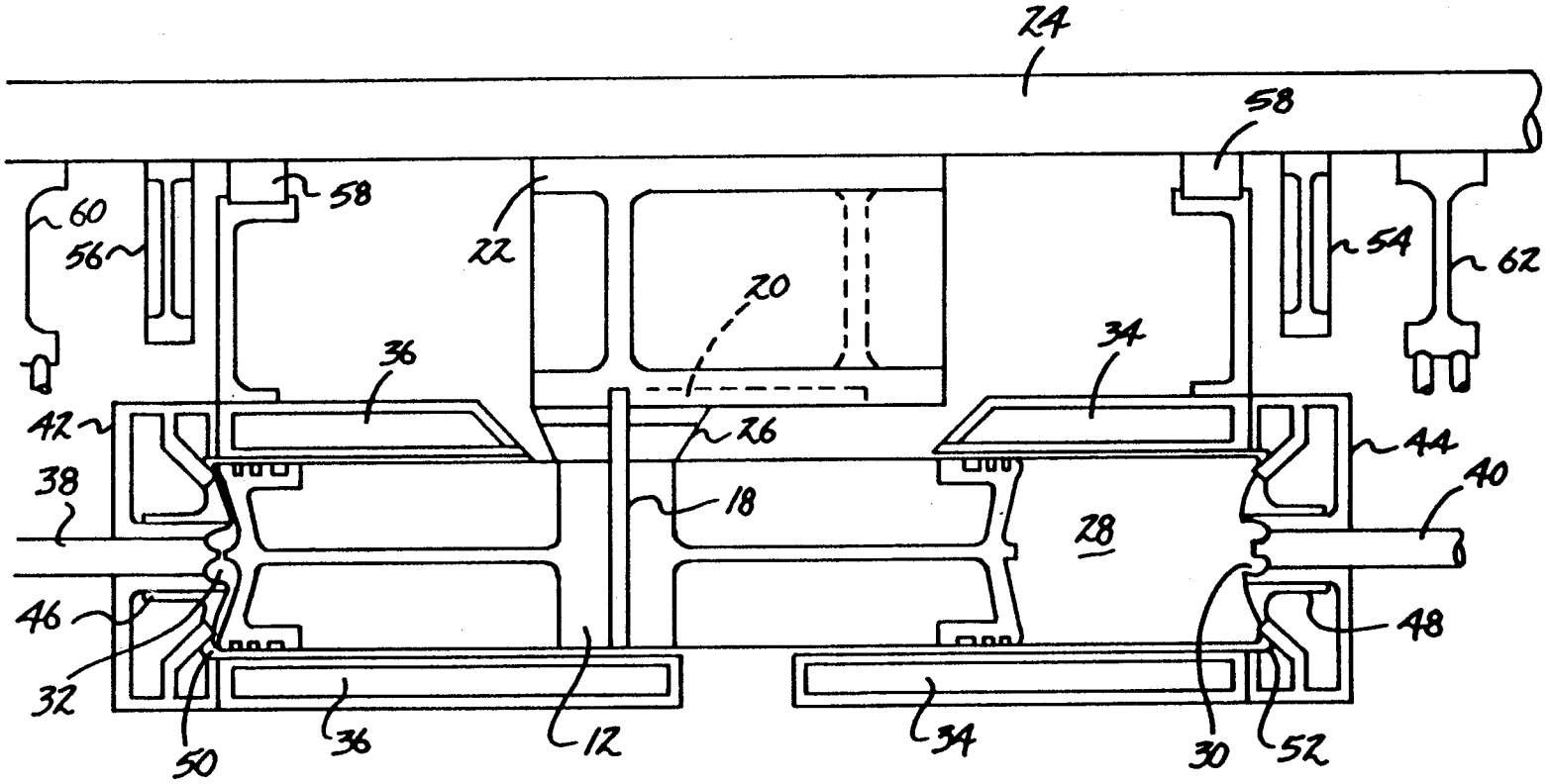

FIGS. 2, 3 and 4 are provided to more clearly illustrate the construction of the power cam wheel 22. As shown, the cam groove 20 on the power cam wheel 22 changes direction every 45 degrees of rotation thereof so that a piston 12 completes four reciprocations within its respective combustion chamber per cam wheel revolution. Inasmuch as the power cam wheel 22 is fixedly secured about the power takeoff shaft 24, one crankshaft revolution is realized for every four complete reciprocal movements of a piston 12 within a combustion chamber. The design of the invention is such that each combustion chamber of a piston 12 fires once every one hundred and eighty degrees of crankshaft 24 rotation, so that each double acting piston fires four times every revolution. In the preferred embodiment of the invention 10 shown in FIG. 1 then, the use of four double acting pistons 12 would result in sixteen combustion firings per crankshaft 24 revolution. This arrangement provides for a much more balanced operation at a much lower engine rpm, while the equivalent piston speed of a prior art reciprocating engine will also be realized. Additionally, the increased combustion firings will result in greater horsepower realization and also greater engine torque. By the same token, the engine can be constructed of lighter materials due to reduced engine vibration and can also be designed to occupy less space than that of an engine having a comparable cubic inch displacement.

FIG. 5 is a somewhat schematic representation of the assembly details of the invention 10. In this regard, the crankshaft 24 is shown with the cam drive wheel 22 operably attached thereto while a typical piston 12 engages the power cam wheel by means of the follower pin 18 which is positioned within the cam groove 20. A driving wheel 26 circumferentially positioned around the driving pin 18 is also illustrated and will be subsequently described in greater detail.

With continuing reference to FIG. 5, it will be noted that the double acting piston 12 is freely reciprocable within a cylinder 28 having opposed combustion chambers 30, 32. The cylinder bore 28 may be surrounded by opposed liquid cooling chambers 34, 36 in a conventional manner; however, air cooling fins which extend radially from the piston 12 could also be utilized in a modified form of the invention. Accordingly, all cooling arrangements which would function to promote engine efficiency and reliability are within the concept and purview of the present invention.

For purposes of illustration, fuel injectors 38, 40 are also shown in FIG. 5, with these injectors being positioned through the respective cylinder heads 42, 44. FIG. 5 also illustrates the forward intake valve 46 as well as the aft intake valve 48. The forward exhaust sleeve valve 50 and the aft exhaust sleeve valve 52 are also shown.

It can be appreciated that various accessories receive their driving power from the crankshaft 24 and accordingly, an aft accessory drive gear 54 is illustrated, as is a forward accessory drive gear 56. The crankshaft 24 is supported in the engine structure by a plurality of support bearings generally designated by the reference numeral 58, and forward and aft valve drive wheels 60, 62, respectively, are also illustrated.

FIG. 6 and 7 of the drawings more particularly illustrate the operable arrangement between the respective pistons 12 and the aforementioned drive ring assembly 26. In this connection, the driving ring 26 is circumferentially positioned around the power cam wheel 22 and is designed to receive and retain the followers 18 in a secure manner relative to the pistons 12, thus to prevent follower distortion during the combustion process. The ring 26 slidably travels along the circumferential surface of the power cam wheel 22 in a manner obvious by reference to FIGS. 5, 6 and 7.

Figure 8:
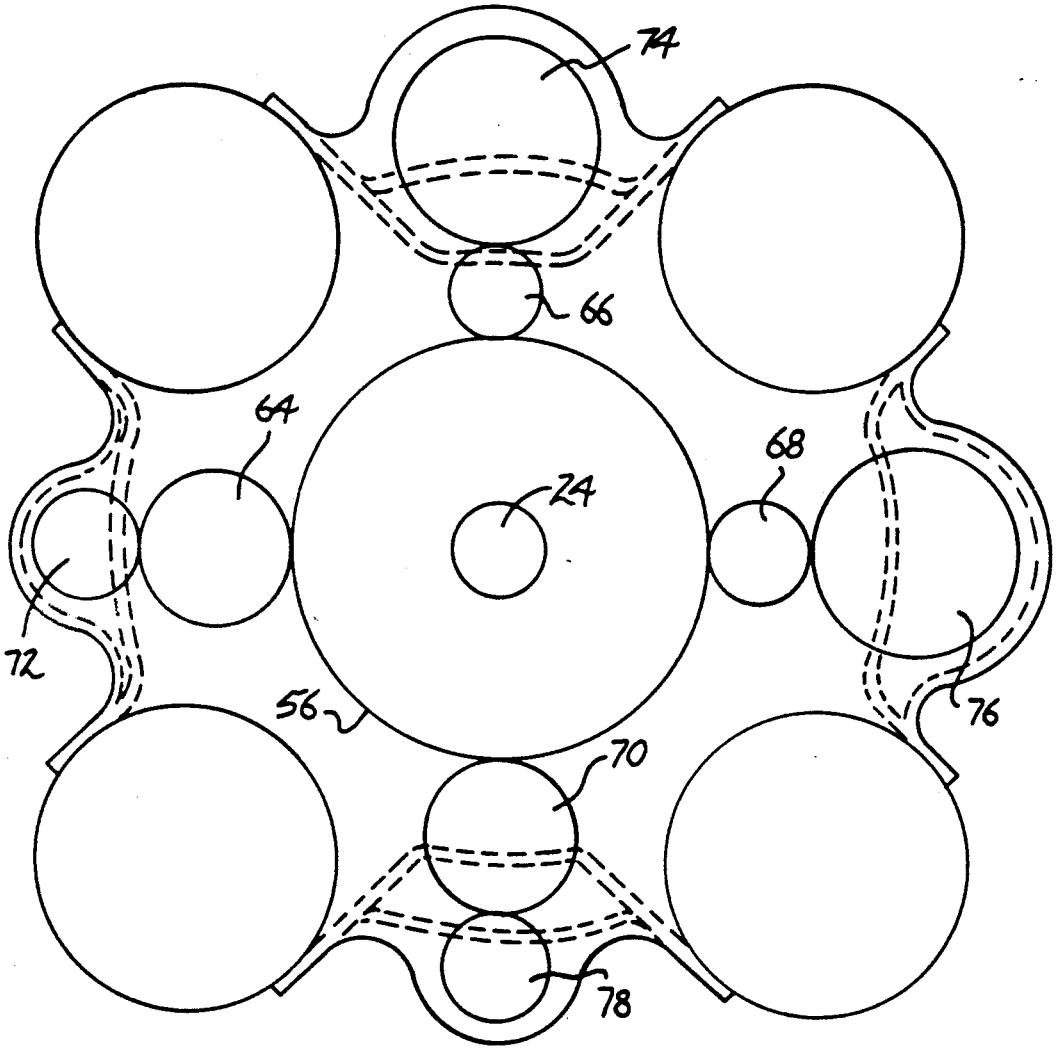
FIG. 8 is an end view representation of the various drives associated with the invention.
Figure 9:
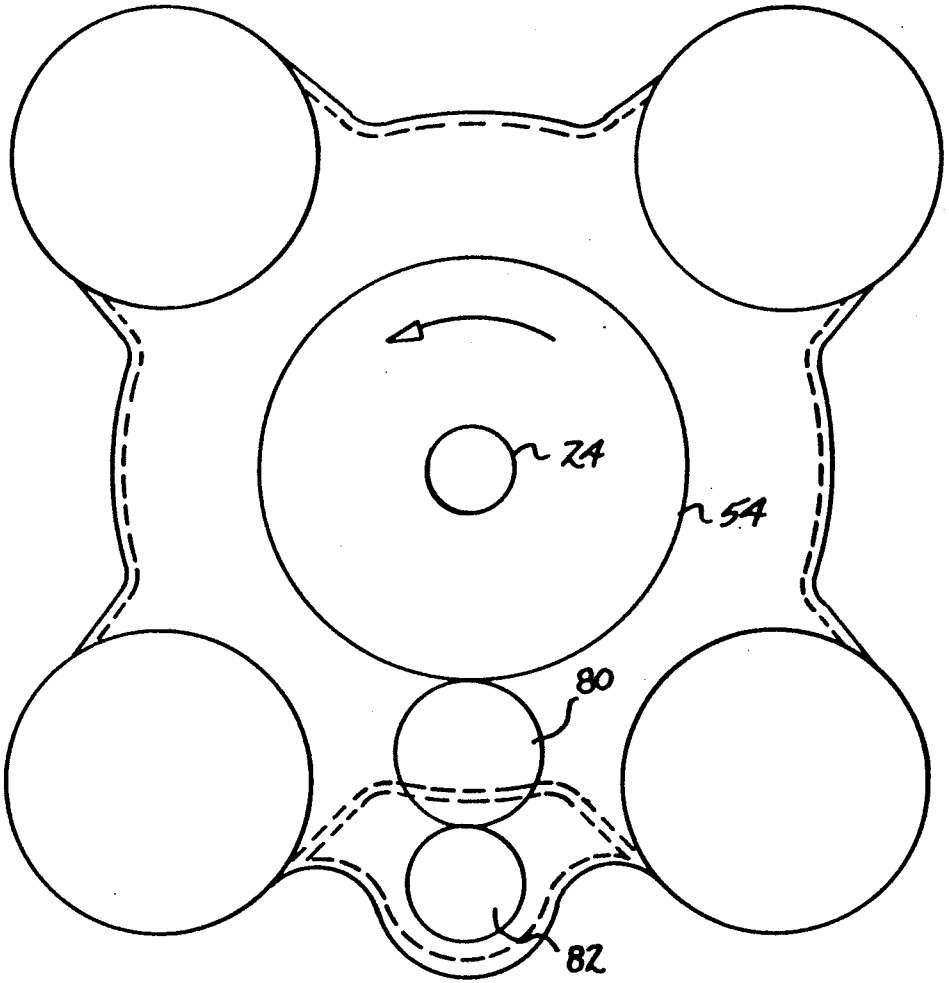

FIG. 8 of the drawings illustrates the front end accessory drive arrangement envisioned for use in the construction of the present invention 10. In this regard, the forward accessory drive gear 56, which is fixedly secured to the crankshaft 24, is designed to engage a plurality of idler gears 64, 66, 68, 70. The idler gear 64 could be utilized to engage a water pump drive gear 72, and the idler gear 66 would engage a fuel pump drive gear 74. Similarly, the idler gear 68 could engage an oil pump drive gear 76, and the idler gear 70 would engage an alternator or generator drive gear 78.

Figure 9:
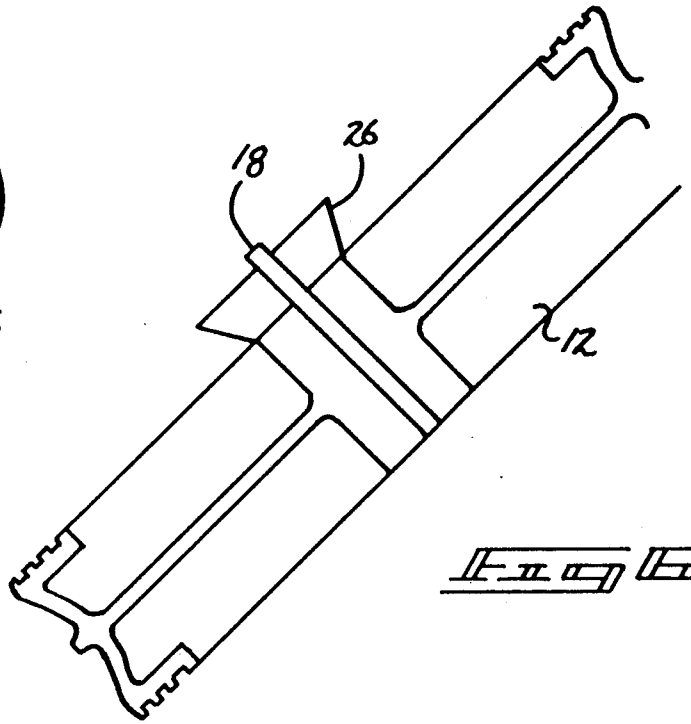
FIG. 9 is an end view representation of the power takeoff arrangement forming a part of the invention.
Figure 11:
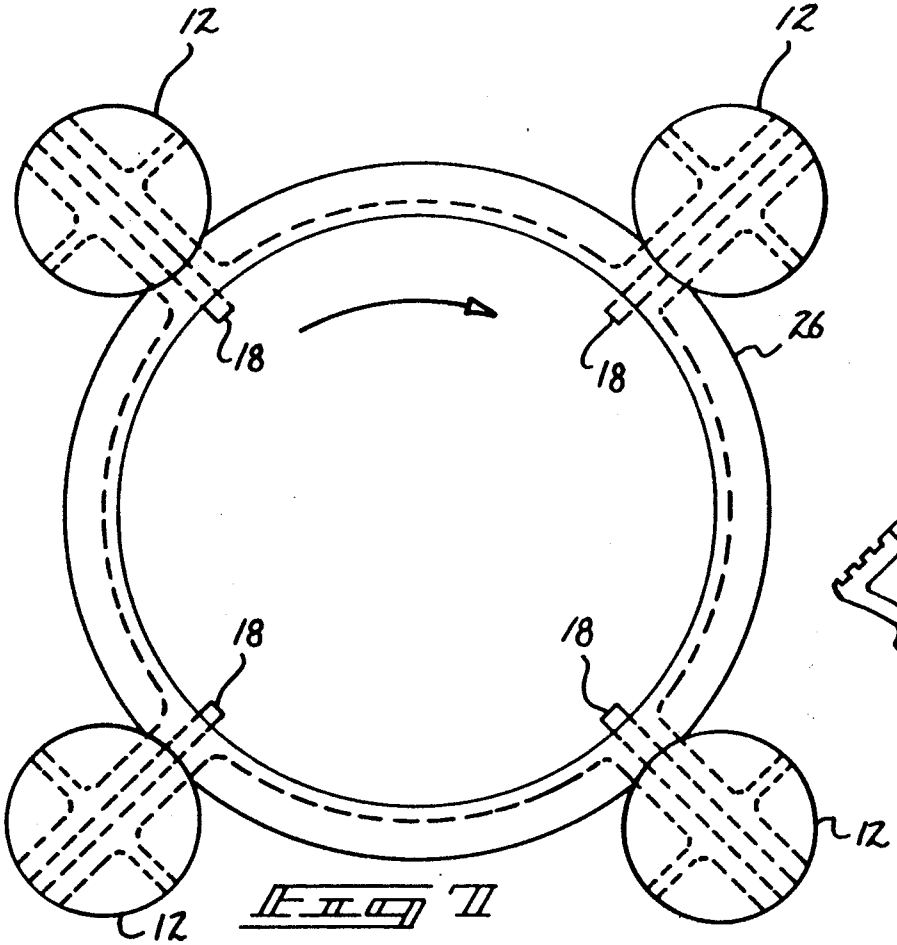
FIG. 11 is an end representation of the valve drive arrangement forming a part of the invention.
Figure 10:
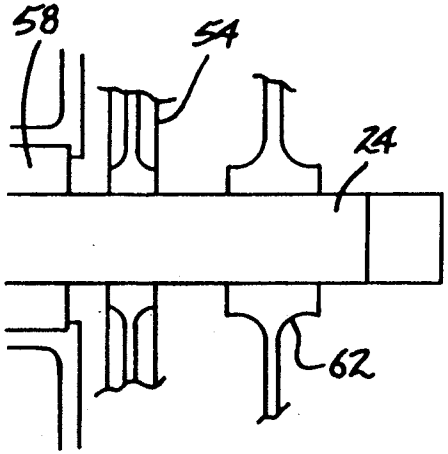
FIG. 10 is a side elevation view of the power takeoff arrangement.
Figure 11:
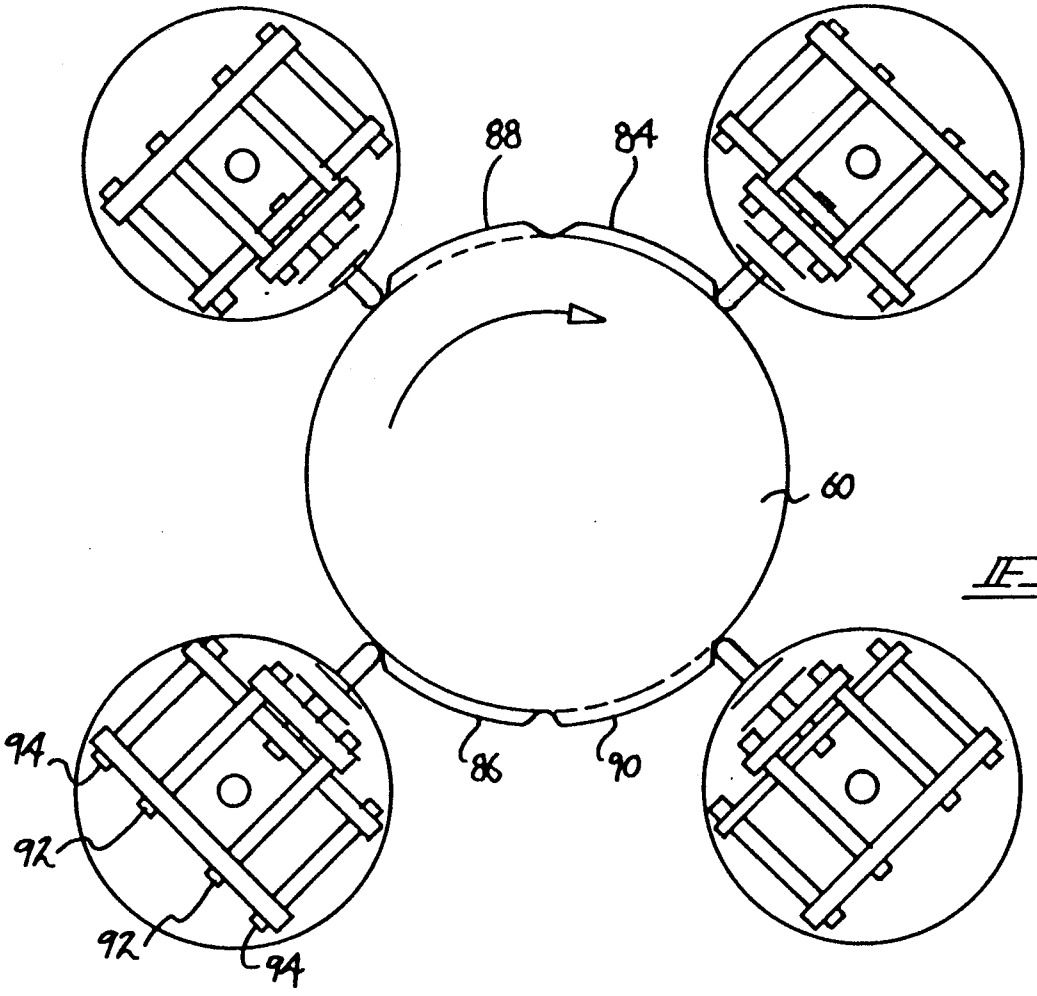
Figures 11A, 11B, 11C:
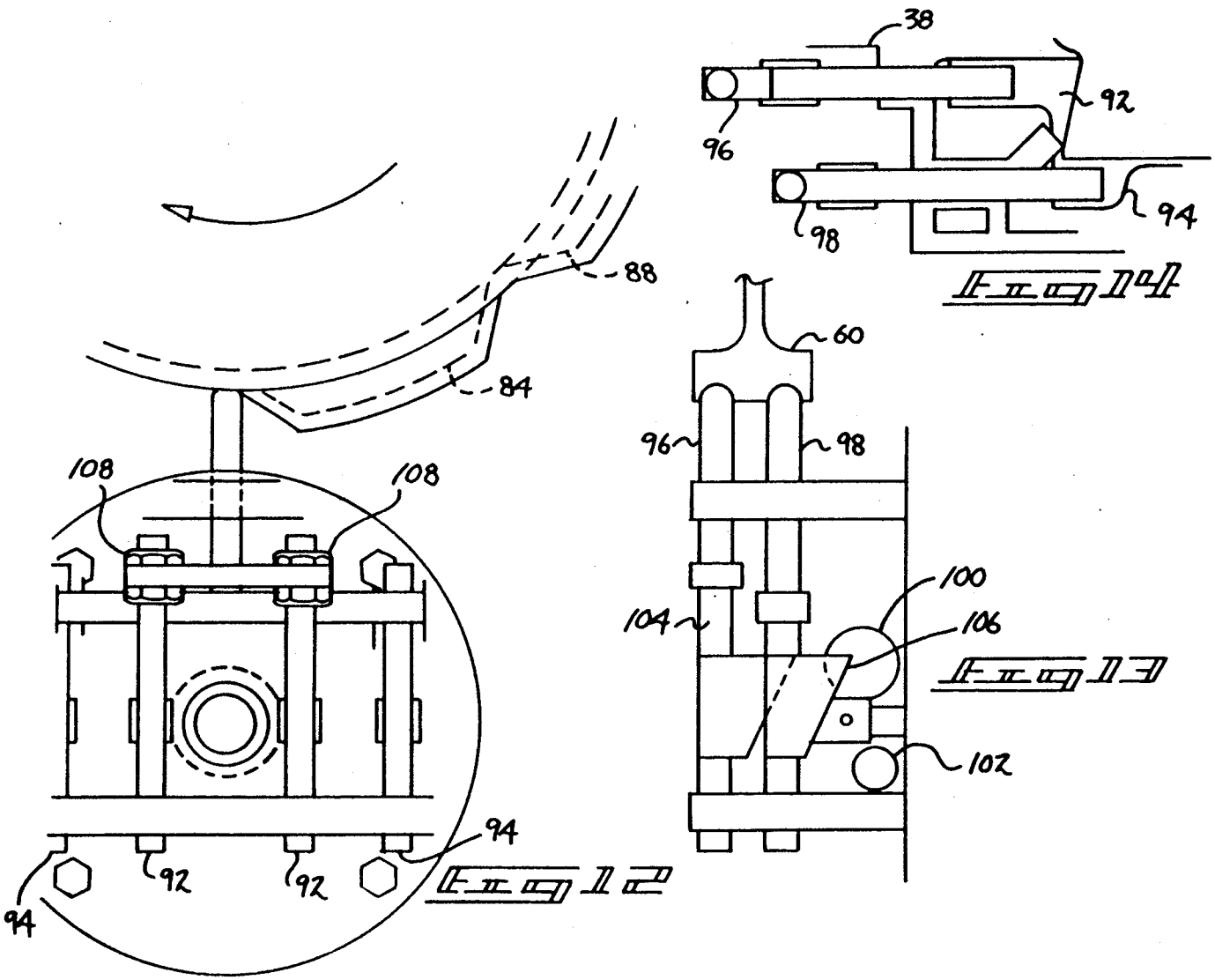
Figure 11:
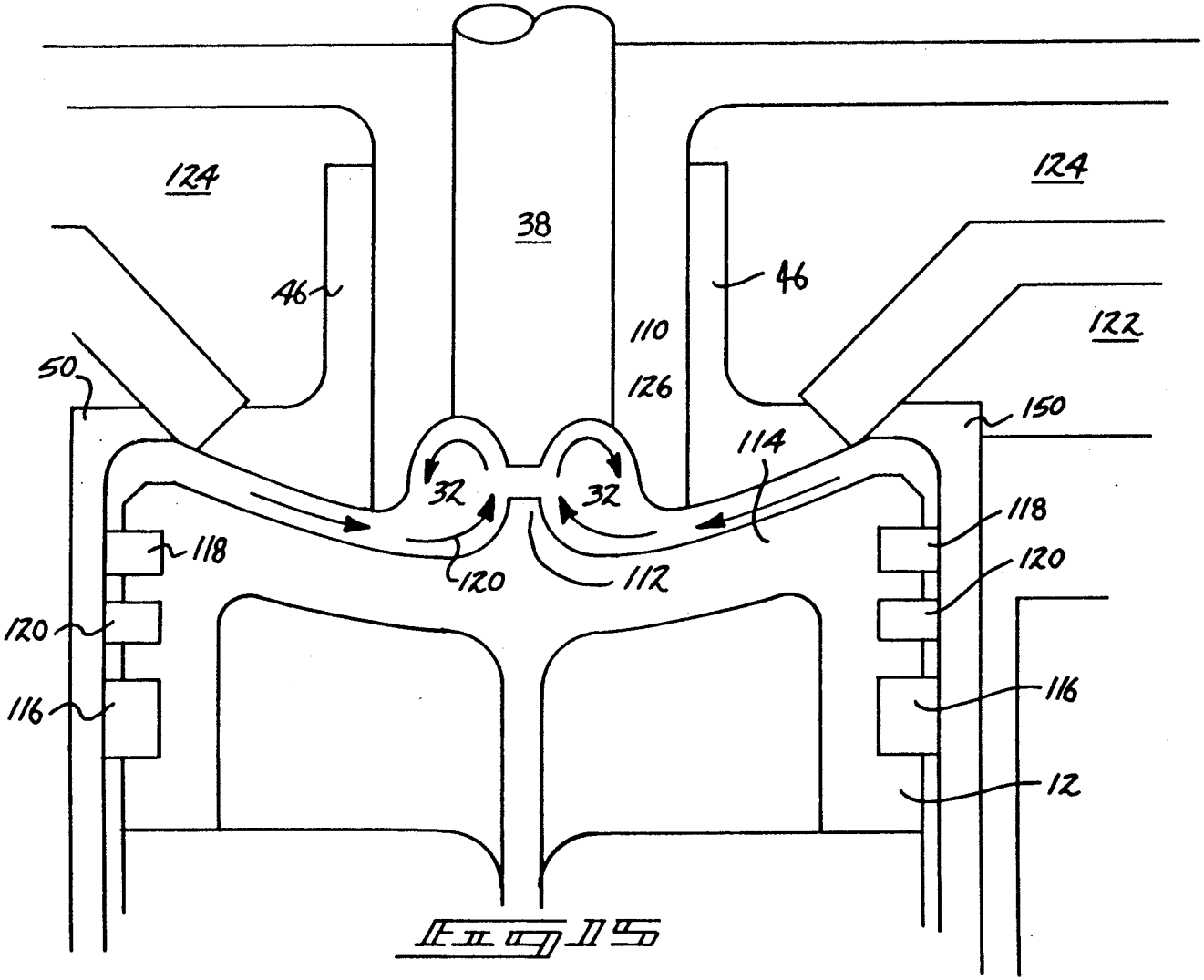

FIGS. 9 and 10 illustrate the aft end accessory drive gear 54 and its associated power takeoff arrangement. As previously noted in FIG. 5, the aft accessory drive gear 54 is fixedly secured to the power takeoff shaft 24, as is the aft valve drive wheel 62, and in the preferred embodiment engages an idler gear 80 which would in turn engage a starter drive gear 82. Any number of other accessory drive arrangements could also be provided as desired,; however, none of these further accessory drives are illustrated in the drawings.

FIGS. 11, 12, 13 and 14 are provided to illustrate the basic operation of the aforementioned valve drive wheels 60, 62. In this regard, the operation of both valve drive wheels 60, 62 is similar so that only the operation of the valve drive wheel 60 will be described. As shown, a typical valve wheel will include exhaust valve cam surfaces 84, 86 and intake valve cam lobes or surfaces 88, 90. The rotation of the valve drive wheel 60 results in an operable timed movement of the intake valves 92 and the exhaust valves 94. The intake valves 92 are moved by followers 96 and the exhaust valves 94 are reciprocably moved by followers 98. As is apparent, the followers 96 are reciprocably moved by the intake lobes 88, 90, and the followers 98 are reciprocably moved by the exhaust valve cam lobes 84, 86 during a rotation of the valve drive wheel 60. The valve drive wheel 60, as best illustrated in FIG. 13, continually engages the followers 96, 98, and appropriate spring biasing of the valves in their normally closed position in obtained by the use of torsion springs 100, 102 in a well understood manner. Also, as is well understood by those familiar with the art, an intake rod wedge 104 and an exhaust rod wedge 106 are also utilized to facilitate a proper seating and spring biased action of the associated intake and exhaust valves 46, 50 respectively. Proper valve seating and clearance is obtained by the conventional usage of adjusting nuts 108 as illustrated in FIG. 12.

FIG. 15 of the drawings illustrates the novel combustion chamber design associated with the present invention. Inasmuch as the combustion chambers 30, 32 are identical in design for each piston 12, only the shape and construction of the combustion chamber 32 will be described. More specifically, it can be seen that the combustion chamber 32 is of a substantially toroidal shape defined by a downward extension 110 representing the ejector nozzle of the fuel ejector 38 and an upward extension 112 integrally formed in a central portion of the concavely shaped piston head 114 defining a typical end of a piston 12. The upward extension 112 is of a truncated cone shape and is kept in alignment with the fuel ejector extension 110 by the circumferentially extending oil retention ring 116 and a pair of conventional compression rings 118, 120.

Also clearly illustrated in FIG. 15 is a typical exhaust valve sleeve 50 positioned proximate the exhaust gas chamber 122, while a typical intake valve 46 positioned proximate the intake gas chamber 124 is also illustrated.

Flow arrows 126 illustrate the circuitous and turbulent movement of the compressed combustion air within the toroidally-shaped combustion chamber 32 during a compression stroke prior to combustion, thereby to effect a very substantial mixing of the combustion air and the fuel spray ejected from the fuel ejector 38. This of course results in a much more complete burning of the combustion mixture so as to increase engine efficiency.

With respect to the manner of operation of the present invention 10, the same should be apparent from the above description. In this regard, it can be appreciated that in the preferred embodiment, all four pistons 12 have forward and aft combustion chambers 32, 30 and are fastened in an operable manner to the drive shaft 24 by means of the driving pins 18 engaged in the cam groove 20 of the cam drive wheel 22. The combustion chambers 30, 32 are of a unique design for better air and fuel mixing to thus obtain a for a more complete and cleaner burning, with all of these features having been thoroughly described priorily hereto.

To describe a typical firing cycle of the invention, the four pistons 12 can be temporarily described by numbers one to four in a clockwise manner. At zero degrees to 45 degrees, the forward combustion chambers 32 of pistons one and three fire in the combustion stroke, while the aft chambers 30 are in the compression stroke. At the same time, forward chambers 32 of pistons two and four will be in the intake stroke, while the aft chambers 30 thereof are in the exhaust stroke.

At 45 degrees to ninety degrees, the forward chambers 32 of pistons one and three will be in the exhaust stroke, while the aft chambers 30 are in the combustion stroke. Similarly, the forward chambers 32 of pistons two and four will then be in the compression stroke, while the aft chambers 30 are in the intake stroke.

At 90 degrees to one hundred and thirty five degrees, the forward chambers 32 of pistons one and three will be in the intake stroke, and the aft chambers 30 will be in the exhaust stroke. At the same time, the forward chambers 32 of pistons two and four will be in the combustion stroke, and the aft chambers 30 will be in the compression stroke.

At one hundred and thirty five degrees to one hundred and eighty degrees, the forward chambers 32 of pistons one and three will be in the compression stroke with the aft chambers 30 in the intake stroke. The forward chambers 32 of pistons two and four will be in the exhaust stroke, and the aft chambers 30 will be in the combustion stroke. This operation as above described is then completed every one hundred and eighty degrees of rotation, and will thus result in sixteen power combustion strokes for every complete rotation of the crankshaft 24.

The design of the invention 10 as described above is for diesel operation with about a sixteen to one compression ratio, and the engine will not need spark plugs or glow plugs to ignite combustion. The design can be adapted for other fuels, such as gasoline, alcohol or dry fuel (butane, propane or natural gas) having compression ratios less than ten to one. Other minor modifications will also be required when other fuels are used. The design of the present invention can include other than four cylinder, four stroke cycle engines of various sizes. For example, for small engines, there could be a three cylinder-two stroke cycle design, and for large horsepower requirements, there could be a six cylinder-four stroke cycle design.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved double acting piston internal combustion engine comprising, at least one double acting piston positioned in an internal combustion engine cylinder having first and second combustion chambers located at opposed ends thereof, said at least one double acting piston having first and second piston heads on opposed ends thereof, said first and second piston heads communicating with said first and second combustion chambers respectively, and cam drive means operably associated with said at least one double acting piston, said cam drive means operably converting a combustion actuated reciprocable movement of said at least one double acting piston into a rotational drive movement, thereby to effect a rotation movement of a drive shaft means so that said drive shaft means functions as a power takeoff for said internal combustion engine, and further including cam groove means positioned in said cam drive means, said follower means operably engaging said cam groove means to effect said rotational drive movement, and wherein said follower means comprises a radially extending pin orthogonally positioned relative to a reciprocable movement axis of said at least one double acting position, and further including a drive ring means slidably movable over a circumferential surface of said cam drive means, said drive ring means retaining said follower means therein and directing said follower means into said cam groove means.

2. A new and improved double acting piston internal combustion engine as described in claim 1, wherein said cam drive means comprises a power cam wheel of a cylindrical shape, said cam groove means being circumferentially machined around a peripheral surface of said power cam wheel, said power cam wheel being fixedly secured to and rotatable with said drive shaft means.

* * * * *